United States Patent [19]

Ravi et al.

[11] Patent Number: 5,028,845

[45] Date of Patent: Jul. 2, 1991

[54] HIGH-PRESSURE SERIES ARC DISCHARGE LAMP CONSTRUCTION

[75] Inventors: Jagannathan Ravi, Elmira; Kenneth E. Pearson, Canisteo; Jay J. Palmer, Bath, all of N.Y.; Ronald C. Marburger, Ekeren, Belgium; John P. Dunn, Hammondsport, N.Y.; Kent L. Collins, Hammondsport, N.Y.; Dale E. Brabham, Elmira, N.Y.; Kathleen P. Bernard, Painted Post, N.Y.; Herbert Bayne, Hornell, N.Y.; John Alderman, Corning, N.Y.; Kris Aelterman, Hoboken, Belgium

[73] Assignee: North American Philips Corporation, New York, N.Y.

[21] Appl. No.: 455,728

[22] Filed: Dec. 21, 1989

[51] Int. Cl.[5] ..... H05B 41/00

[52] U.S. Cl. ..... 315/189; 315/324; 313/285

[58] Field of Search ..... 315/189, 324; 313/285

[56] References Cited

U.S. PATENT DOCUMENTS 4,751,432 6/1988 Van Delm ..... 315/178
4,906,888 3/1990 Dunn et al. ..... 313/1

FOREIGN PATENT DOCUMENTS 1332852 10/1973 United Kingdom .

OTHER PUBLICATIONS

ANSI C78.1352-1981.
ANSI C78.1352-1990.
ANSI C78.1350-1990.
ANSI/ASC C78.1350 ∝ 1985.

*Primary Examiner*—David Mis
*Attorney, Agent, or Firm*—William Squire

[57] ABSTRACT

A 1000 watt arc discharge arc tube assembly comprises two series connected side-by-side arc discharge tubes whose combined break down voltage in sufficient for a standard 2-5 kv starting pulse to simultaneously start both arc tubes without additional structure. A standard ballast, starter and fixture can be used with the arc tube assembly whose overall length is less than 300 millimeters. The lamps are spaced sufficiently apart to preclude detrimental heat transfer effects on one another and sufficiently close to act as a single source of light in standard fixtures normally employing lamps having a single discharge tube.

8 Claims, 1 Drawing Sheet

HIGH-PRESSURE SERIES ARC DISCHARGE LAMP CONSTRUCTION

Figure 1:
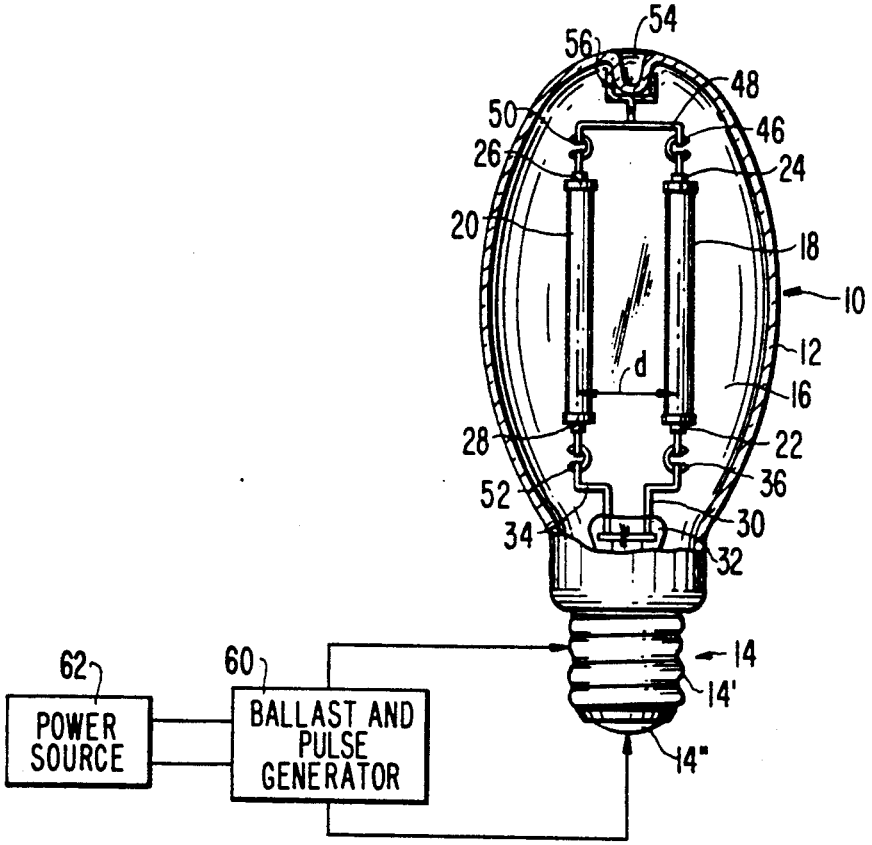

This invention relates to a high-pressure discharge lamp employing series connected discharge arc tubes.

Of interest is co-pending U.S. application Ser. No. 455,729 filed concurrently herewith entitled "High-Pressure Sodium Discharge Lamp Construction" in the name of Ravi et al. and U.S. Pat. No. 4,751,432 issued in the name of Van Delm, both of which are assigned to the Assignee under the present invention.

High powered series discharge lamps are described in the above-mentioned U.S. Pat. No. 4,751,432 and in British Patent Specification No. 1,332,852. In such lamps, two discharge arc tubes are connected in series and located within an evacuated outer bulb. Series connected tubes are employed to provide increased illumination in a smaller package in the case of the U.S. patent or to correct the color of the light emitted by the combined discharge tubes by using, for example, different types of discharge tubes in the series combination as illustrated in the British patent. Typically, a high voltage starting pulse is required to start such discharge tubes at high pressure. Such starting pulses are typically around 2 to 5 kv.

It is the general belief in this art that such a starting pulse will not start two series connected discharge tubes as illustrated for example in the aforementioned U.S. patent. To avoid this problem as disclosed in that patent, a bimetal switch is placed across one of the discharge tubes which are connected in series but in side-by-side spaced relation. The bimetal switch is placed between the two tubes. The switch is normally closed, short circuiting one of the tubes. When a high voltage starting arc pulse is applied across the two series connected discharge tubes, the pulse is applied effectively only across one discharge tube because of the presence of the short circuit bimetal switch across the other tube.

The bimetal switch is placed between the tubes so that when the one tube, which is started by the high-voltage pulse, reaches its operating temperature, the heat radiated to the bimetal switch causes the switch to open. This creates a high-voltage arc pulse across the one which is off at this time. That high-voltage starting pulse is then used to start that second tube so that both lamps will then be in the operating mode. The use of a bimetal switch adds additional components and processes to the manufacturing of the lamp. The present inventors recognize a need to provide a series connected high-pressure discharge lamp of the type disclosed in the aforementioned U.S. patent but avoid the need for using additional starting means for one of the two series connected discharge tubes.

A complication to the above-noted problem is that discharge lamp constructions typically have a threaded cap which is mated with a threaded socket in standard conventional fixtures. In order to properly operate the discharge tubes, such fixtures are available with standard ballasts for stabilizing the current in the circuit with the tubes and with standard starting devices for generating the starting pulse of a given amplitude. Such starters, for example, have been standardized for producing pulses in the range of 2 to 5 kv.

Because of the generally widely held belief that additional starting means need be provided for starting two series connected arc discharge tubes such a starting means is provided in the discharge lamp of the aforementioned U.S. patent for use with such standardized starters and ballasts. The present inventors therefore recognize a need for a discharge lamp with series connected arc discharge tubes which is useful with such standardized fixtures, ballasts and starters without additional structure in the lamp itself. Further as disclosed in the aforementioned British patent specification, typical prior art discharge lamps have additional wire frames located within the outer bulb for supporting the interior discharge tube structures. For example, in the British patent specification, the outer bulb includes a dimple at one end opposite the cap for supporting one end of a wire frame structure which in turn supports the discharge tubes. Because the discharge tubes in the British patent are connected in series end-to-end, they present a relatively long structure which is not believed to be particularly suitable for standardized fixtures employed with relatively low power discharge lamps, for example, lamps at 400 watts or lower dissipation power. Further, the British Patent is silent as to starting the lamps.

While the lamp of the type disclosed in the aforementioned U.S. patent when used with two series connected 500 watt discharge tubes may operate at 1000 watt dissipation power, typical single 1000 watt lamp fixtures are relatively long for accommodating relatively longer discharge tubes capable of operating at the 1000 watt dissipation power. Such long prior art discharge tubes typically comprise a single tube which is undesirably longer than a 500 watt or 250 watt discharge arc lamp tube. Typically ballasts and starters for fixtures accommodating the shorter discharge lamps of relatively lower power range have ballast values and starting voltage values adapted for starting such lower power discharge lamps. While standardized fixtures, ballasts and starters are available for use with the longer 1000 watt single discharge arc tubes, as discussed above, it is not generally believed that such starters are capable of starting two series connected 500 watt discharge tubes for producing a 1000 watt discharge lamp.

However, the present inventors realize that in providing a starting pulse with a standard starter, the pulse when applied across a series connected set of discharge tubes is required to jump, from a practical point of view, a distance represented by the end-to-end spacing of the two series connected tubes. Typically, in a single tube configuration, the starting pulse need merely jump the distance presented by the end-to-end distance of that single tube, thus, the rationale for the bimetal switch in the aforementioned U.S. patent. That is, in that structure, the starting voltage pulse need only jump a distance represented by the end-to-end distance of a single discharge tube. The present inventors recognize, however, that if the end-to-end distance of the two series connected discharge tubes presented a distance such that a conventional 2 kv to 5 kv starting pulse were able to jump that distance, that pulse would be able to start both discharge tubes simultaneously. What this means is that such a lamp construction may be made available for use in standard fixtures presently on the market. This is important because the fixture manufacturers do not necessarily desire to implement non-standard components in a standard commercial product. Therefore, it is vitally important that a high-pressure discharge lamp which mates with a standard fixture must not require additional non-standard components such as ballasts or starters.

A high-pressure discharge lamp construction in accordance with the present invention which is responsive to a conventional starting voltage pulse of a given amplitude normally employed for a single discharge tube of a given operating power level and having a given length comprises an outer bulb and first and second high pressure discharge tubes within the outer bulb. The tubes have substantially similar discharge power operating characteristics which together provide an operating power level equivalent to the operating power level of the single tube. The arc tubes are each so constructed so that When connected in series their combined end-to-end starting (break-down) voltage is substantially equivalent to the starting voltage of the single discharge tube. Means are provided for electrically conductively connecting the discharge tubes in series with the tubes positioned in spaced relation whereby the conventional starting pulse supplied simultaneously starts both lamps.

A feature of the invention includes spacing the tubes sufficiently close to present an effective single source of light to a reflecting fixture and sufficiently far apart so as to have negligible detrimental heat transfer effect on one another.

IN THE DRAWING

Figure 2:
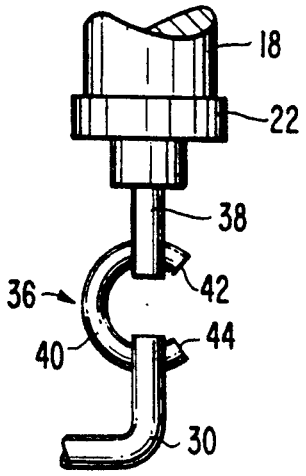

FIG. 1 is a side elevation view partially in section of a lamp construction in accordance with one embodiment of the present invention and including a schematic diagram of a circuit for operating that tube construction; and FIG. 2 is a more detailed elevation view of a portion of the assembly of FIG. 1.

In FIG. 1, lamp assembly 10 includes an outer bulb 12 and a cap 14 which is sealed to the bulb 12 which encloses evacuated chamber 16. The overall length of assembly 10 is less than 300 mm. Within the bulb 12 are two series connected arc discharge tubes 18 and 20, preferably high pressure sodium lamps. A pair of niobium feed-throughs 22 and 24 are attached to opposite ends of arc tube 18. A pair of similar niobium feed-throughs 26 and 28 are attached to opposite ends of arc tube 20. A bent wire electrical conductor 30 is electrically connected to shell contact 14' of cap 14 at one end and secured in place by an insulating stem 32. A second electrical conductor 34 is electrically conductively connected to eyelet contact 14'' of cap 14 at one end and also secured in place by insulating stem 32.

A C-shaped conductor assembly 36 conductively couples conductor 30 to feed-through 22. In FIG. 2, assembly 36 is shown in more detail and comprises a metal C-shaped spring member 40 whose one end 42 is electrically connected to feed-through 22 by conductor 38 and whose other end 44 is connected to conductor 30. Feed-through 28 of arc tube 20 is connected to conductor 34 by a C-shaped conductor assembly 52 which may be identical to assembly 36 which is representative. The other feed-through 24 of arc tube 18 and feed-through 26 of arc tube 20 are electrically conductively connected by a bent conductor 48 whose one end is connected to feed-through 24 by C-shaped conductor assembly 46 and whose other end is connected to feed-through 26 by assembly 50. Assemblies 46 and 50 may be identical to assembly 36. The assembly 36 is typical of other C-shaped assemblies employed in the construction of lamp assembly 10 and therefore the description of assembly 36 is a representative. However, because the discharge tubes 18 and 20 comprise pairs, in certain implementations it may be desirable for the pair of assemblies 36 and 52 to be identical and the pair of assemblies 46 and 50 to be identical but the pairs may differ in size from one another.

The bulb 12 includes an inwardly depending dimple 54. A metal spring clip 56 is secured at one end to the dimple 54 and at the other end somewhat centrally of conductor 48. The clip 56 provides mechanical support for the conductor 48 and for the ends of the arc tubes 18 and 20 next adjacent to the dimple 54. The conductors 30, 34, assemblies 36, 46, 50, and 52 and conductor 48 are so constructed as to provide not only mechanical support for the two arc tubes 18 and 20 but to provide such mechanical support without the need of an additional frame wire.

The arc tubes 18 and 20 are placed on a center-to-center distance d in side-by-side relation in parallel. Distance d is set a value such that the arc tubes are sufficiently spaced apart so that the heat from either lamp does not detrimentally effect the other lamp, and deteriorate the lamp operation. That distance is believed to be a minimum of about 15 millimeters when the tubes 18 and 20 are about 9 millimeters in diameter. The arc tubes 18 and 20 are also set a maximum distance apart so that when the lamp assembly 10 is placed in a standard fixture normally employing a single discharge tube, the two tubes appear optically as a single source of light. The distance d in the latter case for maximum spacing is about 30 millimeters for tubes of 9 millimeter diameter. This spacing d between the two lamps 18 and 20 is essential for optimum operation of the lamp in conventional fixtures. It is also desired that the arc tubes 18 and 20 be assembled within an outer bulb 12 normally employed with a single discharge tube. The object is to employ as many commercially available standard components as possible while providing a relatively higher power lamp in a smaller package.

The contacts 14' and 14'' of the cap 14 are connected to a standard ballast and pulse generator 60. A conventional power source 62 supplies electrical power to the ballast and pulse generator 60. The ballast and pulse generator 60 are standardized assemblies which provide typical starting voltage pulses having an amplitude of about 2 to 5 kv. For example, as shown in American National Standard Specification ANSI C78.1352-1981, issued in 1981, the conventional starting pulse for a single 1000 watt lamp is given in paragraph 5.1 as $2675 \pm 25$ volts at a pulse duration of $3.95 \pm 0.05$ microseconds. In comparison, in specification ANSI C78.1350-1985, issued in 1985, the conventional starting pulse for a single 400 watt lamp is given in paragraph 6.1 as $2225 \pm 25$ volts and a pulse duration of $0.95 \pm 0.05$ microseconds. While the lamp assembly 10 comprises two discharge tubes 18 and 20, the ballast 60 is of conventional standardized design normally employed for example with single tube 1000 watt lamps. The arc tubes 18 and 20 are operated at a level of about 500 watts each. As a result, the arc tube assembly 12 and ballast 50 are of standard dimensions and provide power outputs double that of prior lamps of similar dimensions, for example, 1000 watts as compared to 500 watts of prior art systems. This construction provides a reduced cost in that no additional starting means need be provided to the lamp assembly 10 for starting one discharge lamp at a time such as a bimetal shorting switch. Further, the standardized ballast 60 is one normally available in present fixtures and the lamp assembly 10 can be assembled to such standard fixtures without additional tooling and manufacturing costs for a nonstandard fixture. By providing the clip 56, the support load presented to the conductors 30 and 34 may be reduced somewhat from that provided by a support structure excluding the clip 56 construction. In this way, further cost reductions are obtained.

The reason that the arc tubes 18 and 20 may be operated with a single voltage pulse simultaneously and turned on simultaneously when using a conventional pulse at a pulse amplitude range of 2 to 5 kv is as follows. The voltage pulse when applied to the arc tubes 18 and 20 is applied across a series gap representing by the linear distance between feed-throughs 22 and 28. This linear distance between feed-throughs 22 and 28 when the arc tubes 18 and 20 are relatively high power, for example, 500 watts, provide a distance sufficiently small to permit a standard starting voltage pulse amplitude to be applied to both discharge tubes 18 and 20 simultaneously. It should be understood that the starting voltage pulse amplitude is also a function of the fill gas composition and pressure, electrode spacing and other known factors. The fact that a voltage pulse of preferably 4 to 5 kv range amplitude is sufficient to start, say, two 500 watt high pressure sodium (HPS) discharge tubes in series is not generally known in this art. For example, the linear distance between feed-throughs 22 and 28 is 232 mm. This distance corresponds to a distance in which the 4 to 5 kv pulse will provide a starting pulse to both tubes simultaneously. Previously, in single arc tube constructions having 1000 watt power dissipation, a 4 to 5 kv starting pulse amplitude was employed. The present construction therefore eliminates the need for a bypass switch over one of the tubes to ensure a starting volt pulse is applied to only one of the arc tubes in a given time.

The present concept of two arc tubes in series which do not require additional starting means such as a bypass switch is solely applicable to cases where the starting voltage level of the two series arc tubes is comparable to the starting voltage required by a single arc tube of double the power and lamp operating voltage. Am example given above was the 1000 W lamp with a nominal operating voltage range of 194–278 V. This is replaced by two 500 W discharge tubes in series whose combined voltage is in the same range as above. Another possibility is the replacement of a 150 W, 100 V (nominal) arc tube with two 70 W, 50 V (nominal) arc tubes in series.

What is claimed is:

1. A high pressure discharge lamp construction responsive to a conventional starting voltage pulse of a given amplitude normally employed for a single discharge tube of a 1000 watt power level and having a given length, said construction comprising:

an outer bulb;

first and second high pressure discharge arc tubes within the outer bulb, said arc tubes having discharge power operating characteristics having a combined power of about 1000 watts which together provide an operating power level equivalent to the operating power level of said single tube, said tubes each being so constructed such that when serially connected their combined end-to-end starting voltage is substantially equivalent to the starting voltage of said single discharge tube;

means for electrically conductively connecting the discharge tubes in series with the lamps positioned in spaced relation whereby said conventional starting pulse applied across both said discharge tubes simultaneously starts both said discharge tubes; and means for applying said conventional starting pulse to said tubes, said pulse being about 2700 volts and having a pulse duration of about 4 microseconds.

2. The construction of claim 1 wherein the arc tubes are spaced in side-by-side relation.

3. The construction of claim 2 wherein the spacing of the arc tubes is such that the arc tubes are sufficiently close to provide an effective single light source and sufficiently spaced apart to exhibit minimum detrimental heat transfer effect on each other.

4. The construction of claim 2 wherein the arc tubes have an outer diameter of about 9 mm and the center-to-center spacing of the first and second arc tubes is in the range of about 15 to 30 mm, each said arc tubes having an operating power of about 500 watts.

5. The lamp construction of claim 2 wherein said arc tubes each have first and second ends, said means for electrically conductively connecting the arc tubes in series including a cap electrode means having first and second electrodes secured to the outer bulb and electrical conductor means for electrically conductively connecting a different electrode to a different arc tube at one end and for supporting said discharge tubes within said outer bulb at said one end, said bulb including a dimple adjacent to the other ends of said tubes, said means for electrically connecting the tubes in series further including electrical conductor means for electrically connecting the other ends and including means for securing the other ends to said dimple.

6. The arc tube construction of claim 1 wherein said arc tubes each comprise a sodium amalgam discharge media.

7. A high power, high pressure sodium discharge lamp construction adapted to operate with a starting voltage pulse of about the same magnitude as a single discharge tube of about the same operating power level, said lamp construction comprising:

an outer bulb having a dimple;

cap means secured to the bulb and including electrical contacts, said cap means forming with the outer bulb a sealed chamber;

first electrode means in said chamber secured electrically conductively to said contacts;

second electrode means secured to said dimple;

first and second elongated sodium high pressure arc discharge tubes in said chamber, said arc tubes having substantially the same operating power level for operating at about a combined power level of about 1000 watts and so constructed such that when serially connected their combined end-to-end starting voltage is substantially equivalent to that of said single discharge tube whose power level is about the same as the combined power level of the first and second discharge tubes, each tube having first and second terminals at opposing lamp ends, the first terminals being secured to said first electrode means for supporting said arc tubes adjacent to said cap means and for applying electrical power to said discharge tubes via said contacts, said second terminals being secured to said second electrode means for securing said arc tubes adjacent to said dimple and for electrically conductively coupling said second terminals, said arc tubes being arranged in spaced side-by-side relation; and ballast means coupled to said cap means for stabilizing current applied to said contacts and for providing a lamp starting voltage pulse simultaneously across both said arc tubes in response to an applied electrical signal, said voltage pulse having a magnitude of about 2,700 volts and a pulse duration of about 4 microseconds.

8. The construction of claim 7 wherein the overall length dimension of said outer bulb is less than 300 mm.

* * * * *